US005613277A

United States Patent [19]

Dallmann et al.

[11] Patent Number: 5,613,277

[45] Date of Patent: Mar. 25, 1997

[54] WINDOW HINGE SHOE

[75] Inventors: Mary B. Dallmann, Owatonna; Gregory O. Voss, Lakeville; Brian D. Dallmann, Owatonna, all of Minn.

[73] Assignee: Truth Hardware Corporation, Owatonna, Minn.

[21] Appl. No.: 607,719

[22] Filed: Feb. 27, 1996

[51] Int. Cl.[6] ..... E05D 15/00; E05D 13/00

[52] U.S. Cl. ..... 16/368; 16/370; 16/193; 49/252

[58] Field of Search ..... 16/368, 369, 370, 16/371, 239, 362–364, 338, 193, 197, 199, DIG. 16; 49/248–252, 445, 446, 452, 453, 181, 174

[56] References Cited

U.S. PATENT DOCUMENTS

| | | | |
|---|---|---|---|
| 3,509,663 | 5/1970 | Miller | 49/248 |
| 3,650,070 | 3/1972 | Ringle, III | 49/252 |
| 3,722,142 | 3/1973 | Anderberg et al. | 49/248 |
| 3,788,006 | 1/1974 | Teggelaar et al. | 16/193 |
| 4,622,715 | 11/1986 | Buckley | 16/370 |
| 4,833,754 | 5/1989 | Yang | 16/369 |
| 5,040,267 | 8/1991 | Dallmann | 49/252 |
| 5,081,743 | 1/1992 | Mayes | 16/370 |

*Primary Examiner*—Chuck Y. Mah

*Attorney, Agent, or Firm*—Wood, Phillips, VanSanten, Clark & Mortimer

[57] ABSTRACT

A hinge for supporting a window sash relative to a window frame including a track (12) connected to the window frame, a support arm (16) pivotally secured to the track, a shoe (22) slidably received in the track (12) and a sash arm connected to the window sash and pivotally supported relative to both the shoe and the support arm (14). The shoe includes a first side (38) which lies adjacent the track (12) when the shoe is received in the track. The shoe further includes a recess (40) in the first side (38) and a pad (42) integrally formed with the shoe body (22). The pad is received in a recess when the shoe is received in the track.

25 Claims, 2 Drawing Sheets

WINDOW HINGE SHOE

BACKGROUND OF THE INVENTION

1. Technical Field

The present invention is directed toward window hinges, and more particularly toward a window hinge shoe which will ensure proper positioning of a pad between the metal screw of the shoe and the track of the hinge, and reduce the cost of manufacturing and assembling the hinge, and simplify the installation of the hinge in the field.

2. Background Art

Window hinges are known in the art for providing pivotal movement of a window between open and closed positions. A hinge assembly mounts a window sash to a window frame and controls the opening and closing of the window. Window hinges typically involve an elongated track mounted to the window frame, a sash arm mounted to the window sash, and a support art interconnecting the track and sash arm, with the support arm being pivotally connected to both the track and the sash arm. The sash arm is pivotally connected, either directly or by means of an interconnecting link, to a mounting shoe which is guided for movement lengthwise along the track. The mounting shoe is typically fitted with a metal screw which regulates the movement of the shoe along the track. The metal screw is secured to the shoe and tightened onto the track to adjust the movement of the shoe along the track according to the strength requirements of the sash arm needed to support the window sash. A hinge as described above is disclosed in U.S. Pat. No. 5,040,267.

In order to prevent the metal screw from galling or gouging the track of the hinge, some window hardware manufacturers include a separate pad with the hinge assembly, to be positioned between the metal screw and the track. This additional part adds to the manufacturing cost of the hinge, as well as the labor cost in assembling and installing the hinge.

The pad is typically made of a plastic material and must be small enough to be positioned between the shoe and the track. In order to be effective, the pad must be positioned between the metal screw and the track, preventing the metal screw from coming in direct contact with the track. During the assembly of the hinge, the position of the pad cannot be seen once the pad is between the shoe and the track. There is no reliable way to visually confirm that the pad is properly positioned in the hinge, making it easy to misalign the pad in the track as the hinge is being installed. A misaligned pad, not discovered because it cannot be seen, may easily go without fixing until after the window hinge is in operation and the track is permanently damaged by the metal screw. Extra effort and attention must be given to the proper positioning of the pad between the metal screw and the track. This time and effort increases the labor costs of assembling the hinge.

Further, the pad is typically a small piece which can be easily lost before it is installed into the hinge. At any time during the manufacture, assembly, or installation of the hinge at the plant, or especially in the field, the small pad can be lost. Special care must be taken to package the pad with the shoe or other hinge parts, so as not to lose the pad prior to its installation into the hinge. Again, the additional time and effort required to keep track of this small part increases the labor cost and complicates the process of manufacturing the hinge.

The present invention is directed toward overcoming one or more of the above discussed problems.

SUMMARY OF THE INVENTION

In one aspect of the present invention, a hinge for supporting a window sash is provided having a track connected to a window frame, a support arm pivotally secured to the track, a shoe slidably received in the track, and a sash arm connected to the window sash and pivotally supported relative to both the shoe and the support arm. The shoe has a first side adjacent the track when the shoe is received in the track and a recess in the first side. A pad is integrally formed with the shoe and received in the recess of the shoe when the shoe is in the track. The pad is biased out of the recess and against the track when the shoe is received in the track.

Other aspects of the invention include a metal insert in the shoe body with a threaded hole therein and a screw through the hole engaging the pad when the shoe is received in the track.

In another aspect of the present invention, a weakened area connects the pad to the shoe body, wherein the weakened area is thinner than the pad.

In another aspect of the invention, the pad is integrally connected to the shoe body only along a first edge of the pad. Three free edges of the pad which are not connected to the shoe body are surrounded by the metal insert in the shoe body.

Other aspects of the invention include a rib defining an end of the recess in the shoe body, wherein the rib extends away from the surface of the recess to a surface not beyond the first side of the shoe body.

It is an object of the invention to provide a hinge which ensures the proper positioning of the pad between the metal screw and the track when the shoe is received in the track. It is another object of the invention to provide a hinge which is cost effective to manufacture and assemble.

It is still another object of the invention to provide a hinge which is easy to assemble in the field, without danger of losing components during the packaging or installation of the hinge.

DESCRIPTION OF THE PREFERRED EMBODIMENT

Figure 1:
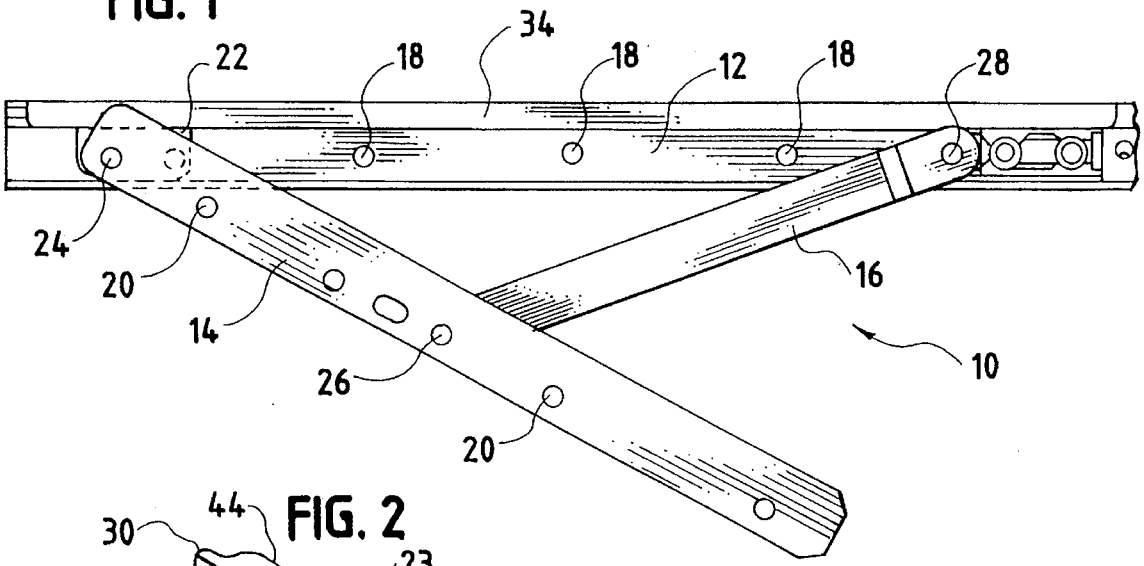
FIG. 1 is a top plan view of a hinge embodying the present invention.

As shown in FIG. 1, a hinge embodying the present invention is generally designated 10, and includes a track 12, a sash arm 14, and a support arm 16. The track 12 contains a guide portion 34 on either one or both sides of the track (only one is shown; the present invention could be used with tracks having either one or two guide portions) and includes a number of openings 18 through which suitable screws (not shown) may be inserted for mounting the track 12 to a window frame (not shown). The sash arm 14 also includes a number of openings 20 through which suitable screws (not shown) may be inserted for mounting the sash arm 14 to a window sash (not shown). The hinge 10 connects the window sash to the window frame for suitable opening and closing of the window (not shown).

As seen in FIG. 1, the sash arm 14 is connected on one end to a shoe 22 by a suitable rivet 24 or the like, for pivotal connection between the sash arm 14 and the shoe 22. The shoe 22, which is described in greater detail further below, is slidably received in the track 12. The support arm 16 is connected to a point selectively fixed on the track 12 by a suitable rivet 28 or the like, for pivotal motion of the support arm relative to the track. At an intermediate location along the sash arm 14, the other end of the support arm 16 is pivotally connected to the sash arm 14 by another suitable rivet 26.

Figure 2:
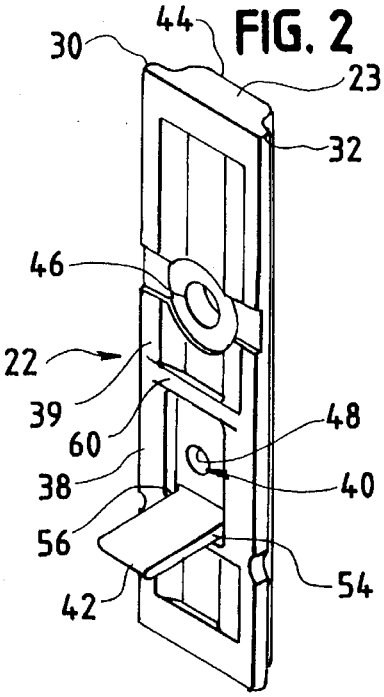
FIG. 2 is a perspective view of the first side of the window hinge shoe embodying the present invention.
Figure 3:
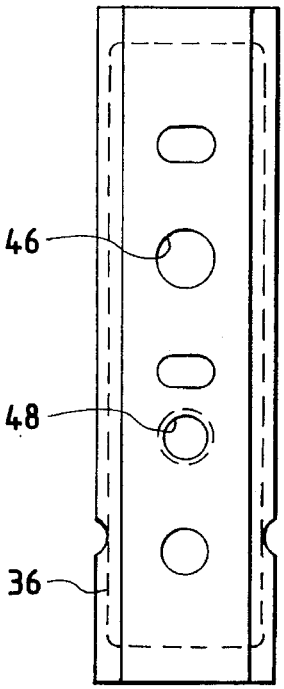
FIG. 3 is a top plan view of the side opposite the first side of the window hinge shoe, embodying the present invention.
Figure 4:
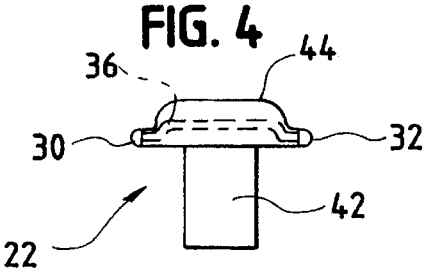
FIG. 4 is a side elevational view of the window hinge shoe of the present invention.

As seen in FIG. 2, the shoe 22 of the hinge assembly 10 is preferably formed of a suitable hard tough plastic material and is adapted to slide in either one or two guide portions 34 (only one guide portion is shown) of the track 12. In the illustrated shoe 22 adapted for use with a track having two guide portions, two longitudinally extending guide ledges 30 and 32 respectively are provided, each of which will ride in respective track guide portions. As shown in FIG. 4, the window hinge shoe 22 of the present invention includes a metal insert 36 which is molded to span the shoe body 22 and extends into the guide ledges 30, 32 for added strength.

As seen in FIG. 4, the window hinge shoe 22 includes a raised portion 44 on which the sash arm 14 is supported. The shoe 22 and metal insert 36 further include a rivet opening 46 through which the rivet 24 (shown in FIG. 1) extends to define the pivot for the sash arm 14.

As illustrated in FIG. 2, the shoe body 22 comprises a first side 38 which lies adjacent the track 12 when the shoe is received in the track. The shoe body 22 further includes a recess 40 in the first side 38 of the shoe, and a pad 42 which is integrally formed with the shoe and received in the recess 40 when the shoe is received in the track 12.

The shoe 22 and the metal insert 36 include a threaded hole 48 through which a metal screw (not shown) extends from the side opposite the first side to engage the pad 42 when the shoe 22 is received in the track 12. The metal screw (not shown) adjustably biases the pad 42 out of the recess 40 and against the track 12 when the shoe is received in the track to allow for adjustment of the drag of the shoe 22 in the track 12.

Figure 5:
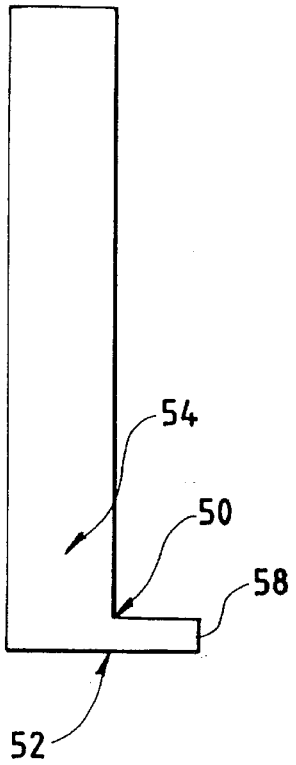
FIG. 5 is an enlarged side elevational view of the pad of the window hinge shoe of the present invention.
Figure 9:
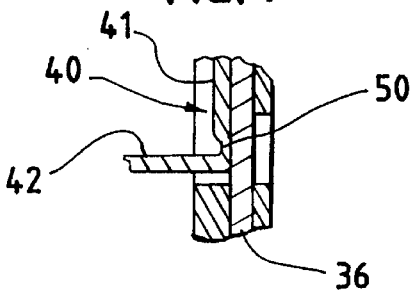
FIG. 9 is an enlarged fragmentary cross-sectional view of the connection between the pad and the shoe body of the present invention, taken along the circle designated by the dash lines of FIG. 8.

As shown in FIGS. 2, 5 and 9, the pad 42 is integrally connected to the shoe body 22 only along a first edge 50 of the pad. Three free edges of the pad, 52, 54 and 56 respectively, are not directly connected to the shoe body 22, and are instead surrounded (when viewed from the first side 38 as in FIG. 6) by the metal insert 36.

A weakened area 58, shown in the form of a lip along an edge of the pad, connects the pad 42 to the shoe body 22.

The weakened area or lip 58, is thinner than the pad, allowing the pad of the shoe to bend or alternatively break away at the weakened area, and be easily received into the recess 40 of the shoe 22 when the shoe is received in the track.

The above configuration of the present invention ensures the proper positioning of the pad on the track of the hinge. The integrally formed pad 42 is automatically positioned between the metal screw and the track 12 when the shoe 22 is received in the track. That is, when the shoe 22 is installed into an end of the track 12, as it is pushed in the projecting pad 42 will encounter the track end so that, upon further installation, the pad 42 will automatically bend at the weakened area 58 so that the pad 42 conveniently folds into the recess 40 and over the threaded hole 48 as is desired.

Therefore, when assembling the hinge, no extra effort is required to properly position the pad between the metal screw and the track. The above described configuration simplifies the installation of the hinge by properly positioning the pad automatically, and by providing an integrally formed pad which will not be lost in the assembly or installation processes. As a result, the window hinge shoe of the present invention reduces the labor costs associated with the assembly and installation of the hinge.

The lip 58 of the pad 42 also advantageously serves to maintain the pad 42 in proper position in the recess 40 in the shoe 22 during the operational life of the hinge. First, as best seen from FIG. 9, the lip 58 is preferably connected to the shoe body along a line which is slightly recessed beneath the recess surface 41, so that bending can occur at the edge of the lip 58 and the length of the lip 58 then serves to allow the pad 42 to lie parallel to the recess surface 41 even though the lip 58 is still connected to the shoe 22 at a line of bending further recessed in the shoe 22. Second, even should the pad 42 break away from the shoe 22 during bending or after protracted use, the lip 58 within the further recess at the end of the pad recess 40 serves to help maintain the pad 42 in the recess 40 during the longitudinal sliding movement along the track 12.

Further, the weakened area 58 enables the pad 42 to bend or break away from the shoe body 22 along a predictable strip between the pad and the shoe body. As the metal screw biases the pad away from the first side 38 and against the track 12 when the shoe 22 is received in the track, the weakened area enables the pad to make an easy and clean break from the shoe if necessary without interfering with the structural integrity of the pad 42. The weakened area 58 enables the pad 42 to be biased against the track 12 along a plane parallel with the track 12, and at the same time eliminates the possibility of the pad breaking in half or snapping away from the shoe during installation at a location which would cause the pad to misalign itself in the hinge. This configuration further ensures the proper positioning of the pad 42 in the shoe 22 to prevent galling of the track 12 by the metal screw.

Figure 6:
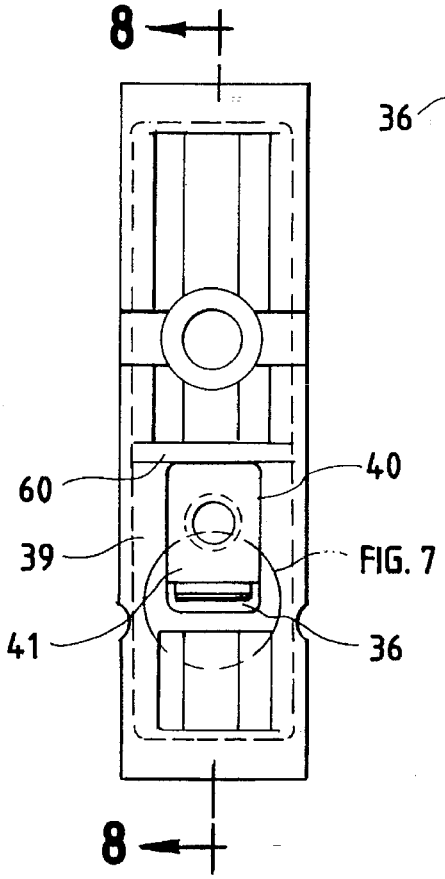
FIG. 6 is a top plan view of the first side of the window hinge shoe of the present invention, omitting the pad.
Figure 7:
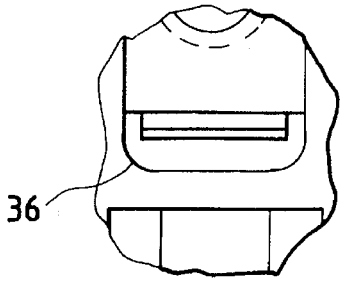
FIG. 7 is a fragmentary enlarged plan view of the present invention taken along the circle designated by the dash lines in FIG. 6.
Figure 8:
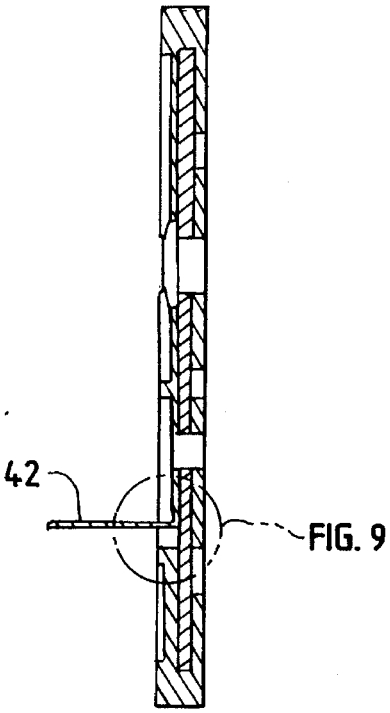
FIG. 8 is a cross-sectional view of the window hinge shoe of the present invention taken along line B—B of FIG. 6.

As shown in FIG. 6, the shoe body 22 further includes a rib 60 which defines an end of the recess 40 in the shoe body 22. The shoe body 22 also includes an outer surface of the first side 38 of the shoe 22 which lies adjacent the track when the shoe 22 is received in the track 12. The rib 60 extends away from a surface 41 of the recess 40, but not beyond the outer surface 39 of the first side 38.

The positioning of the rib 60 provides a barrier at the end of the recess 40 that will stop the pad 42 (which may in some cases break away from the shoe 22 rather than just bend) from migrating from its proper positioning between the metal screw and the track. The rib configuration provides added assurance that the pad 42 of the shoe 22 will remain properly positioned in the hinge 10, preventing damage to the track 12 of the hinge 10.

Still other aspects, objects, and advantages of the present invention can be obtained from a study of the specification, the drawings, and the appended claims.

We claim:

1. In a hinge supporting a window sash relative to a window frame and having a track attachable to the window frame, a support arm pivotally secured to the track, and a sash arm connected to the window sash and pivotally secured to the support arm, an improved shoe slidably received in said track and pivotally connected relative to said sash arm, wherein the improvement comprises:

a shoe body having a first side adjacent a track when received in a track, said shoe body further including a recess in the first side;

a pad integrally formed with the shoe body and received in the recess when the shoe body is received in a track; and means for adjustably biasing the pad out of said recess and against a track when the shoe body is received in a track, said biasing means extending through the shoe body from the side opposite said first side.

2. The improved shoe of claim 1 further comprising a metal insert in said shoe body and including a threaded hole therein, wherein said biasing means comprises a screw through said hole engaging said pad when the shoe body is received in a track.

3. The improved shoe of claim 1 further comprising a weakened area connecting the pad to the shoe body.

4. The improved shoe of claim 3 wherein the weakened area is thinner than the pad.

5. The improved shoe of claim 1 wherein a first edge of the pad is integrally connected to the shoe body.

6. The improved shoe of claim 5 wherein the pad is connected to the shoe body only along the first edge of the pad.

7. The improved shoe of claim 6 further comprising three free edges of the pad which are not connected to the shoe body, and a metal insert in said shoe body adjacent the three free edges of the pad.

8. The improved shoe of claim 1 further comprising a lip along an edge of the pad connecting the pad to the shoe body, said lip being thinner than the pad.

9. The improved shoe of claim 1 further comprising a rib defining an end of the recess in the shoe body, and an outer surface of the first side of the shoe body lying adjacent the track when the shoe is received in the track, said rib extending away from a surface of the recess not beyond the outer surface of the first side of the shoe.

10. A hinge for supporting a window sash relative to a window frame comprising:

a track connectable to the window frame;

support arm pivotally secured relative to the track;

a shoe slidably received in said track with a first side adjacent said track, said shoe including a recess in the first side, a pad integrally formed with said shoe and received in said recess when said shoe is received in said track;

means for adjustably biasing said pad out of said recess and against the track when said shoe is received in said track, said biasing means extending through said shoe from the side opposite the first side to the recess; and a sash arm connectable to the window sash, and pivotally supported relative to both the shoe and the support arm.

11. The hinge of claim 10 further comprising a metal insert in said shoe body and including a threaded hole therein, wherein said biasing means comprises a screw through said hole and engaging said pad when said shoe is received in said track.

12. The hinge of claim 10 further comprising a weakened area connecting the pad to the shoe body.

13. The hinge of claim 12 wherein the weakened area is thinner than the pad.

14. The hinge of claim 10 wherein a first edge of the pad is integrally connected to the shoe body.

15. The hinge of claim 14 wherein the pad is connected to the shoe body only along the first edge of the pad.

16. The hinge of claim 15 further comprising three free edges of the pad which are not connected to the shoe body, and a metal insert in said shoe body adjacent the three free edges of the pad.

17. The hinge of claim 16 further comprising a rib defining an end of the recess in the shoe body, and an outer surface of the first side of the shoe body lying adjacent the track when the shoe is received in the track, said rib extending away from a surface of the recess not beyond the outer surface of the first side of the shoe.

18. A link assembly of a hinge for supporting a window sash relative to a track secured to a window frame, comprising:

a support arm securable for pivotal motion relative to a track;

a shoe slidably receivable in a track with a first side adjacent the track, said shoe body further including a recess in the first side, a pad integrally formed with said shoe, said pad being receivable in said recess when said shoe is received in a track;

means for adjustably biasing said pad out of said pocket and against a track when said shoe is received in a track, said biasing means extending through said shoe from the side opposite said first side to the pocket; and a sash arm connectable to the window sash, said sash arm being pivotally supported relative to both the shoe and the support arm.

19. The link assembly of claim 18 further comprising a metal insert in said shoe body and including a threaded hole therein, wherein said biasing means comprises a screw through said hole and engaging said pad when said shoe is received in a track.

20. The link assembly of claim 18 further comprising a weakened area connecting the pad to the shoe body.

21. The link assembly of claim 20 wherein the weakened area is thinner than the pad.

22. The link assembly of claim 18 wherein a first edge of the pad is integrally connected to the shoe body.

23. The link assembly of claim 22 wherein the pad is connected to the shoe body only along the first edge of the pad.

24. The link assembly of claim 23 further comprising a metal insert in said shoe body.

25. The link assembly of claim 24 further comprising a rib defining an end of the recess in the shoe body, and an outer surface of the first side of the shoe body lying adjacent the track when the shoe is received in the track, said rib extending away from a surface of the recess not beyond the outer surface of the first side of the shoe.

* * * * *